US006325668B1

(12) United States Patent
Sato et al.

(10) Patent No.: US 6,325,668 B1
(45) Date of Patent: Dec. 4, 2001

(54) LAMP SOCKET

(75) Inventors: Kensaku Sato; Tetsuya Takahashi, both of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/526,512

(22) Filed: Mar. 16, 2000

Related U.S. Application Data

(60) Continuation-in-part of application No. 09/345,500, filed on Jul. 1, 1999, now Pat. No. 6,056,575, which is a division of application No. 08/882,533, filed on Jun. 26, 1997, now Pat. No. 5,924,884.

(30) Foreign Application Priority Data

Jul. 12, 1996 (JP) ..... 8-201038

(51) Int. Cl.[7] ..... H01R 13/40
(52) U.S. Cl. ..... 439/587; 439/918
(58) Field of Search ..... 439/336, 731, 439/934, 587, 589, 675, 918

(56) References Cited

U.S. PATENT DOCUMENTS 5,643,006 * 7/1997 Wang et al. ..... 439/419
5,814,765 * 9/1998 Bauer et al. ..... 439/76.1
5,823,806 * 10/1998 Nagase et al. ..... 439/140
5,842,882 * 12/1998 Sato et al. ..... 439/336
5,897,391 * 4/1999 Takashi et al. ..... 439/336
5,924,884 * 7/1999 Sato et al. ..... 439/336
6,056,575 * 5/2000 Sato et al. ..... 439/336

* cited by examiner

*Primary Examiner*—Neil Abrams
(74) *Attorney, Agent, or Firm*—Kanesaka & Takeuchi

(57) ABSTRACT

A lamp socket comprises a socket body (1) having a socket fitting section (4) for receiving a lamp fitting section (81) of a lamp, a first terminal mounting section (9) provided at a center of the socket fitting section (4), a first terminal (40) provided in the first terminal mounting section (9), a second terminal mounting section (10) provided in a circumferential wall of the socket fitting section (4), a second terminal (50) provided in the second terminal mounting section (10), a cover (30) attachable to the back of the socket body (1), first and second terminal receiving cavities (3A, 3B) provided in the socket body (1), a seal groove (34) provided in the cover (30) so as to surround the first terminal cavity (3A), a seal insulation member (70) provided in the seal groove (34), and a seal press portion (14) provided on the back of the socket body (1) such that when the cover (30) is attached to the socket body (1), the seal press portion (14) is fitted into the groove (34) to press down the seal insulation member (70) in the groove (34).

1 Claim, 12 Drawing Sheets

LAMP SOCKET

This application is a continuation-in-part of application Ser. No. 09/345,500 filed on Jul. 1, 1999, now U.S. Pat. No. 6,056,575, which is a div. of Ser. No. 08/882,533 filed Jun. 26, 1997, now U.S. Pat. No. 5,924,884.

BACKGROUND OF THE INVENTION

1. Field of the Invention

The present invention relates to lamp sockets for receiving lamps such as automobile headlights.

2. Description of the Related Art

Recently, lamps as bright as daylight, such as automobile headlights, have been developed. Japanese patent application Kokai No. 172156/90 discloses such an automobile headlight. As FIG. 11 shows, the headlight includes a socket 90 with a plug section 91 having a plate 93 which extends rearwardly from a housing section 92. Two plug pins 94 and 95 extend through the plate 93 into a sleeve 96. In order to withstand against high voltages produced upon turning on the lamp, partition walls 98 and 99 of an insulation material are provided between the plug pins 94 and 95 within the sleeve 96 and a cavity 97, which is closed with a removable cover.

Alternatively, a resin is charged or fused between the plug pins 94 and 95 to withstand against the high voltages.

However, when the partition walls 98 and 99 are used between the plug pins 94 and 95, a small gap is created and satisfactory voltage resistance is not obtained. Consequently, when an instantaneous high voltage, such as 30 KV, is applied, a spark is produced between the plug pins 94 and 95, causing damage to the equipment.

When a resin is charged or fused between the plug pins 94 and 95, the number of assembling steps is increased, resulting in the increased manufacturing costs.

Where the partition wall 98 is provided between the plug pins 94 and 95 in the cavity 97, which is closed with a removable cover, the socket 90 and the cover make noise owing to the vibration of a vehicle.

SUMMARY OF THE INVENTION

Accordingly, it is an object of the invention to provide a lamp socket which withstands against instantaneous high voltages and does not require a large number of assembling steps, thus reducing the manufacturing costs.

According to one aspect of the invention there is provided a lamp socket which includes a socket body having a socket fitting section for receiving a lamp fitting section of a lamp; a first terminal mounting section provided at a center of the socket fitting section; a first terminal provided in the first terminal mounting section; a second terminal mounting section provided in a circumferential wall of the socket fitting section; a second terminal provided in the second terminal mounting section a cover attachable to the back of the socket body;

first and second terminal receiving cavities provided in the cover; a seal groove provided in the cover so as to surround the first terminal cavity; a seal insulation member fitted in the seal groove; and a seal press portion provided on the back of the socket body such that when the cover is attached to the socket body, the seal press portion is fitted into the groove to press down the seal insulation member in the groove.

DESCRIPTION OF THE PREFERRED EMBODIMENT

Figure 1:
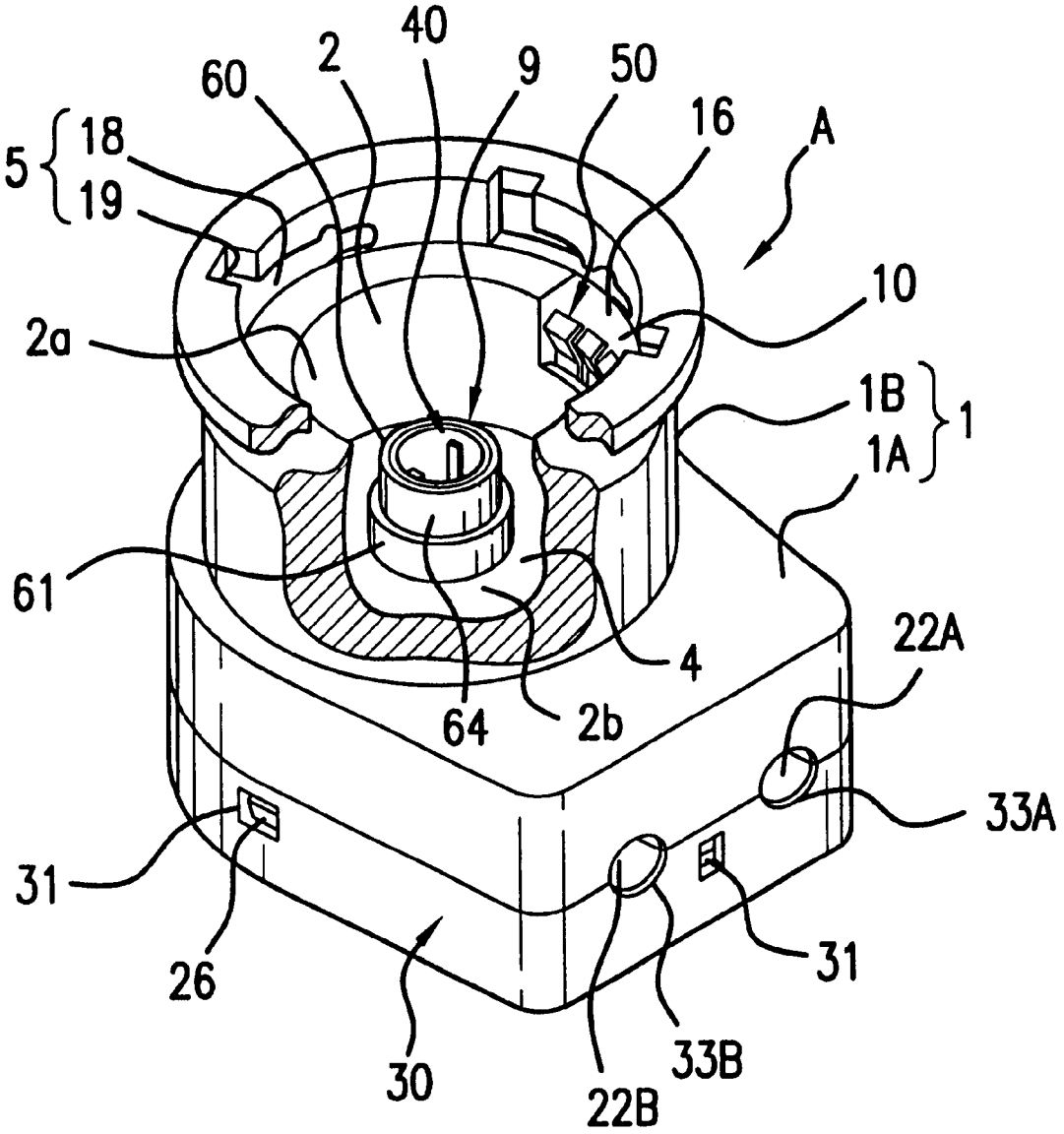
FIG. 1 is a partially cutaway perspective view of a lamp socket according to an embodiment of the invention.

In FIGS. 1–5, a lamp socket A includes a socket body 1, a cover 30, a first terminal 40 provided at the center of the socket body 1, a second terminal 50 provided at a periphery of the socket body 1, an insulation seal member 60; and a seal insulation member 70 made from an insulation material.

The socket body 1 has a base section 1A having a square front and a round back, and a round lamp fitting section 1B extend upwardly from the base section 1A. A fitting cavity 2 is provided within the lamp fitting section 1B. A first terminal mount 9 having a tubular section 6, a socket fitting section 4, and a lamp fitting section 5 are provided in the fitting cavity 2.

The socket fitting section 4 has an annular space, defined by the tubular section 6 and an inner side wall 2*a* of the fitting cavity 2. The insulation seal mounting section 7 extends from the top face of the tubular section 6 through its outer side face to the bottom surface 2*b* of the fitting cavity 2. A mount recess 9A is provided in the first terminal mount 9. A second terminal mount 10 is provided in the side wall of the socket fitting section 4.

A terminal aperture 15 extends from the mount recess 9A of the first terminal mount 9 to a first mating terminal receiving cavity 3A provided on the back of the base 1A.

The second terminal mount 10 is provided in the side wall 16 and separated from the socket fitting section 4, and a mating terminal receiving cavity 16A is provided in the top of the side wall 16. A plurality of terminal apertures 17 extend from the terminal mount 10 to a mating terminal receiving cavity 3B provided on the back of the base 1A.

The lamp fitting section 5 consists of a plurality of engaging grooves 18 provided at predetermined intervals in the circumferential direction of the fitting cavity 2 and insertion openings 19 each communicated with an end of the engaging grooves 18.

Figure 3:
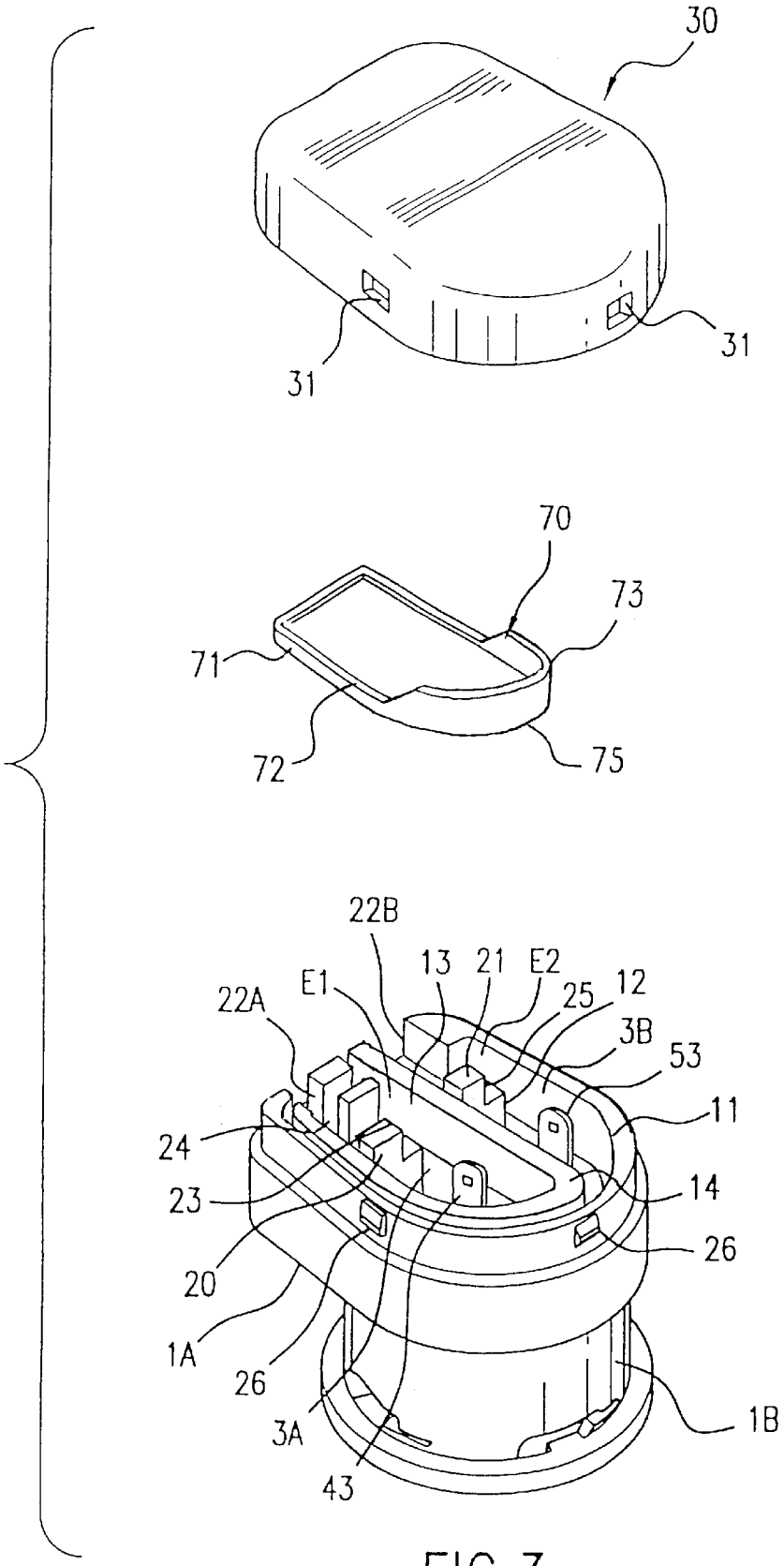
FIG. 3 is an exploded perspective view of the lamp socket as viewed from back.
Figure 4:
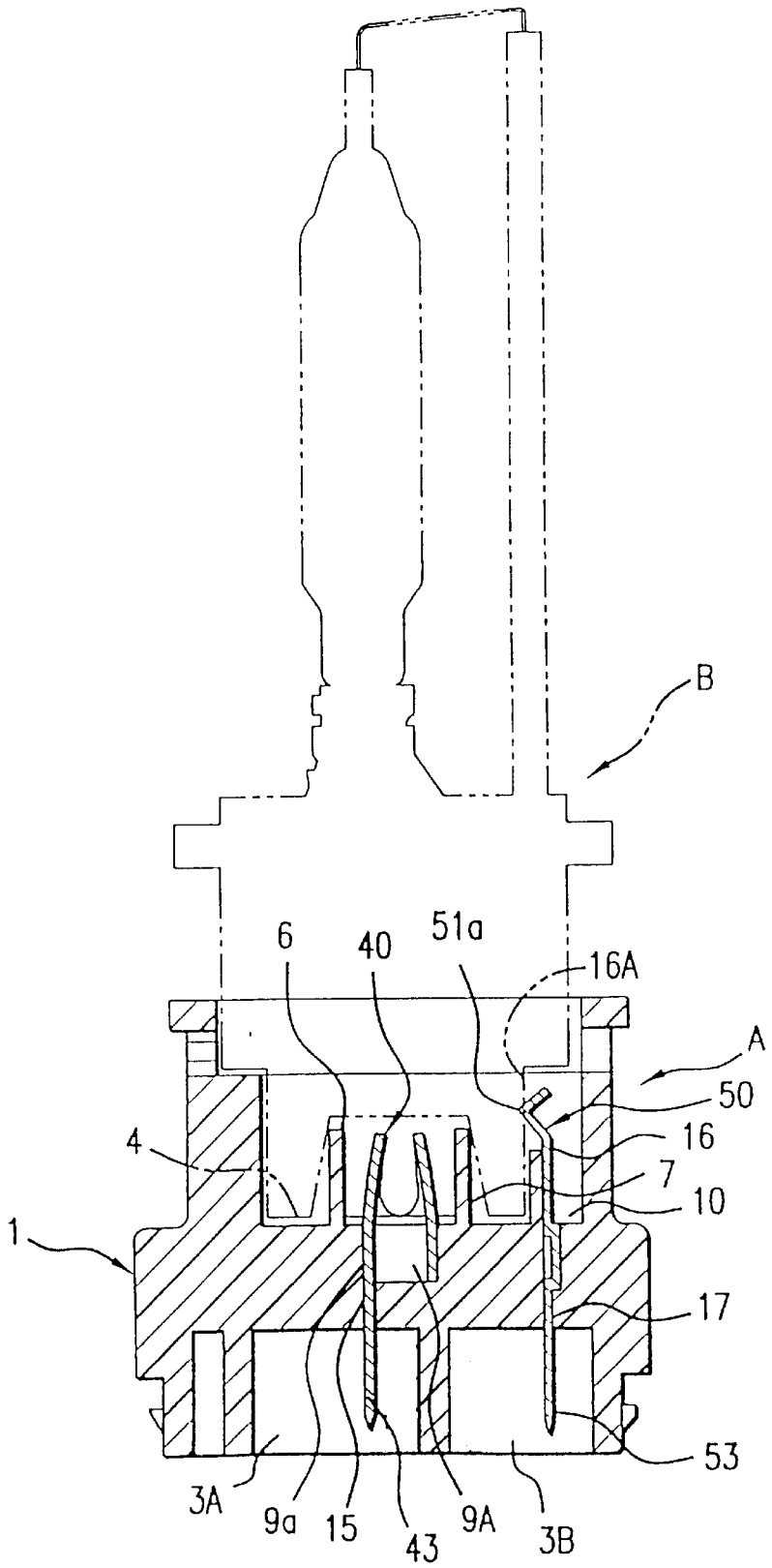
FIG. 4 is a longitudinal section of the lamp socket without the cover.
Figure 5A:
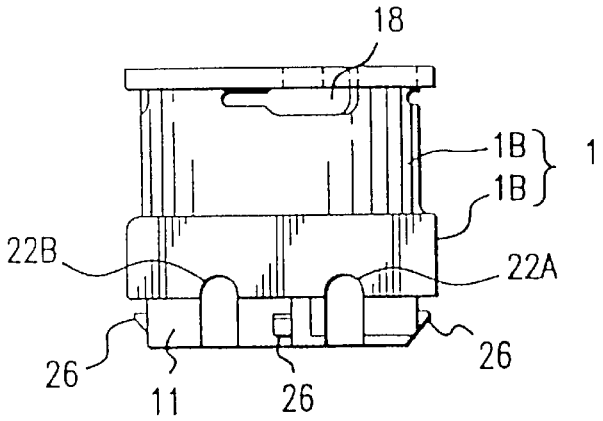
FIGS. 5A, 5B, and 5C are a front view of a socket body of the lamp socket, a front view of the lamp socket, and a rear view of the lamp socket, respectively.
Figure 5B:
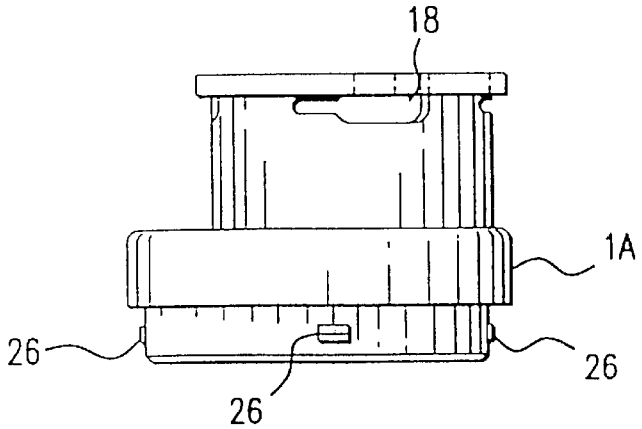
Figure 5C:
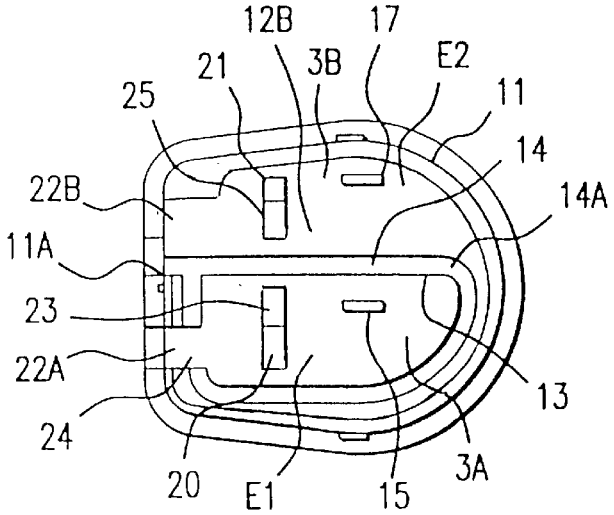

In FIGS. 3 and 5C, a fitting wall 11 having the same configuration as the base 1A and a partition wall 12 for dividing the fitting wall 11 into halves; i.e., first and second areas El and E2 are provided in the longitudinal direction of the socket.

A seal press position forming wall 13 is provided in the area E1 at predetermined distances from the fitting wall 11 and the partition wall 12 to provide a loop-like seal press portion 14.

A separation wall 20 is provided in the first area E1 within the seal press portion forming wall 13 in a second direction perpendicular to the longitudinal direction of the socket to cooperate with the seal press portion forming wall 13 to define the first mating terminal receiving cavity 3A. A separation wall 21 is provided in the second area E2 in the second direction to cooperate with the fitting wall 11 and the partition wall 12 to define the second mating terminal receiving cavity 3B. The terminal apertures 15 and 17 open at the mating terminal receiving cavities 3A and 3B, respectively.

A pair of wire outlets 22A and 22B are provided in a front face 11A of the fitting wall 11. The first wire outlet 22A communicates with the first mating terminal receiving cavity 3A via cutouts 23 and 24 of the partition wall 20 and the seal press portion forming wall 13, respectively. The second wire outlet 22B communicates with the second mating terminal receiving cavity 3B via a cutout 25 of the partition wall 21. A plurality of engaging projections 26 are provided on the fitting wall.

In FIGS. 8A–8D, the cover 30 has a side wall 31. An engaging holes 32 is provided on the side wall 31 and wie outlets 33A and 33B are provided on a front end face of the cover 30. A loop-like seal groove 34 is provided on the inner face of the cover 30 for receiving the seal press portion 14 of the base 1A. A cutout 35 is provided on a front end of the seal groove 34.

Figure 6A:
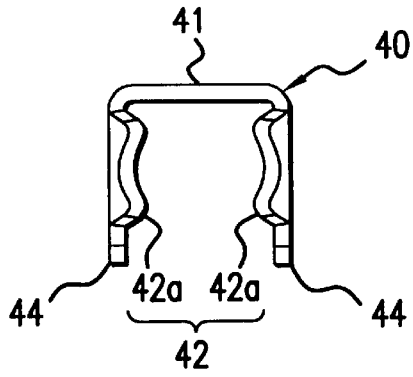
FIGS. 6A, 6B, and 6C are a plan view of a first terminal, a side view of the first terminal viewed from an arrow, and a front view of a portion of terminal leg, respectively.
Figure 6B:
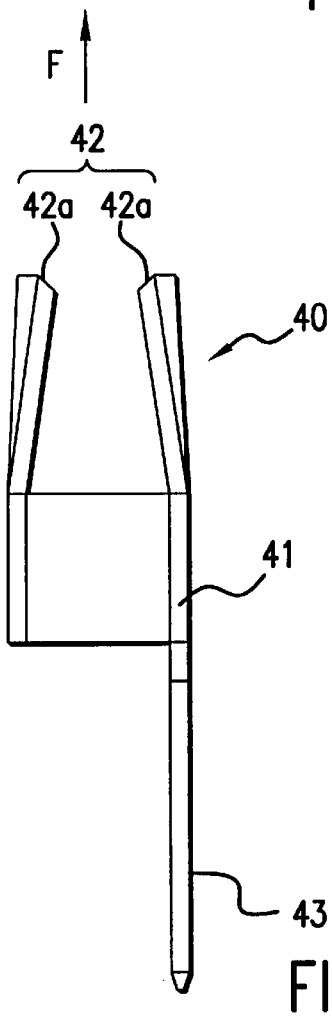
Figure 6C:
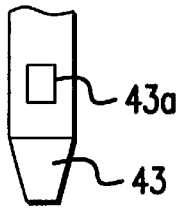
Figure 7A:
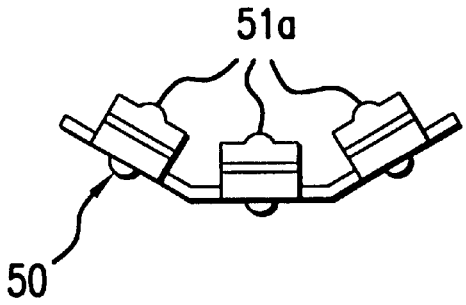
FIGS. 7A, 7B, 7C, and 7D are a plan view of a second terminal, a side view of the second terminal viewed from an arrow, a bottom view of the second terminal, and a sectional view taken along line 7D—7D of FIG. 7C, respectively.
Figure 7B:
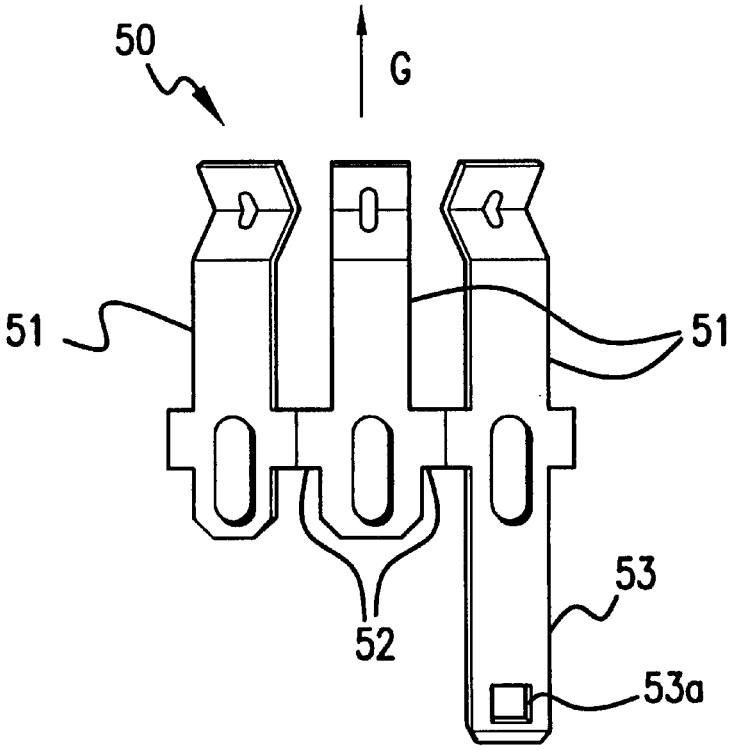
Figure 7C:
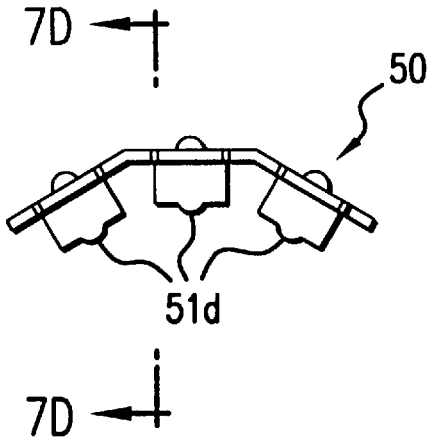
Figure 7D:
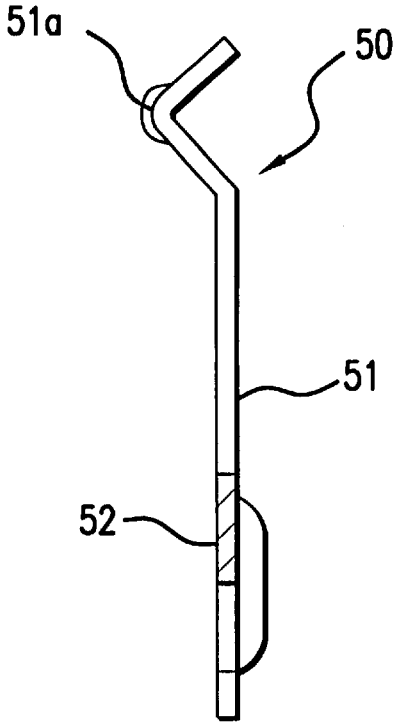
Figure 8A:
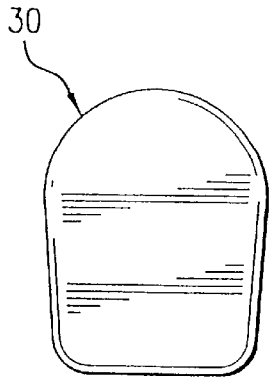
FIGS. 8A, 8B, 8C, and 8D are a plan view of a cover of the lamp socket, a front view of the cover, a bottom view of the cover, and a sectional view taken along line 8D—8D of FIG. 8C, respectively.
Figure 8B:
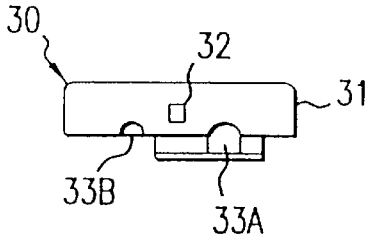
Figure 8C:
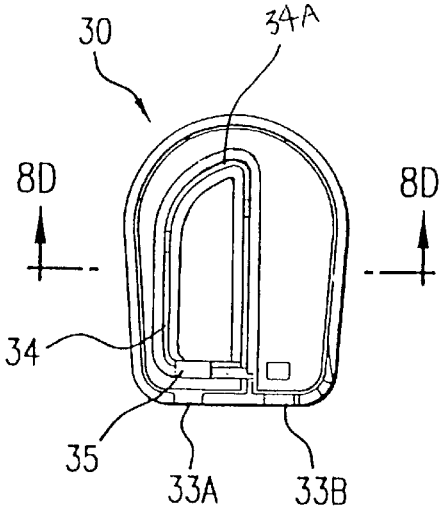
Figure 8D:
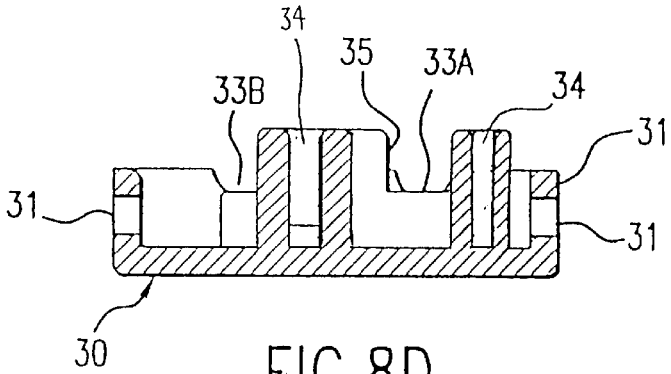
Figure 9A:
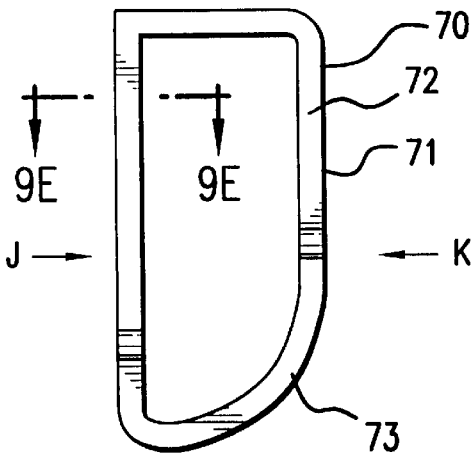
FIGS. 9A, 9B, 9C, 9D, and 9E are a plan view of a seal insulation member, a bottom view of the seal insulation member, a side view of the seal insulation member viewed from an arrow K, and a sectional view taken along line 9E—9E of FIG. 9A, respectively.
Figure 9B:
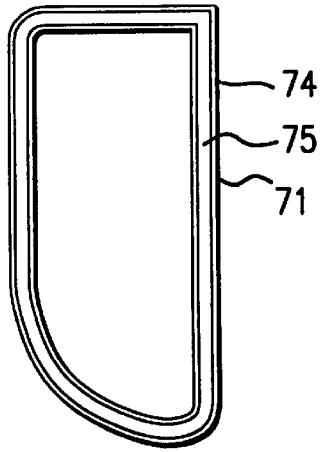
Figure 9C:
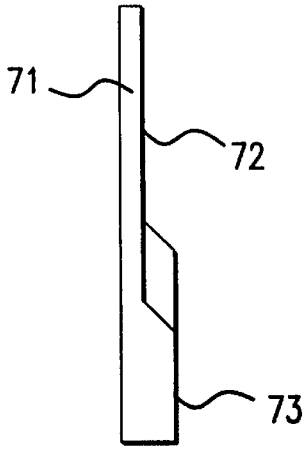
Figure 9D:
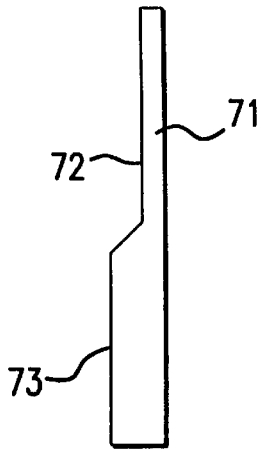
Figure 9E:
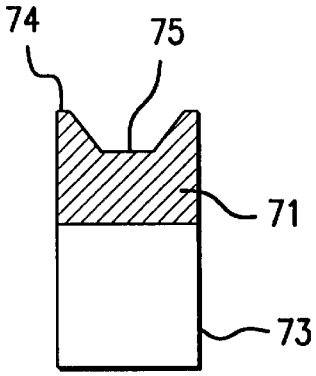

In FIGS. 6A–6C, the first terminal 40 has a press fitting section 41 having a C-shaped cross section, a lamp contact section 42 consisting of a pair of opposed contact portions 42*a* extending upwardly from the press fitting section 41, and a terminal leg 43 extending downwardly from the press fitting section 41. A pair of engaging portions 44 are provided on upper corners of the press fitting section 41. An engaging hole 43*a* is provided in the terminal leg 43.

In FIGS. 7A–7D, the second terminal 50 has three terminal sections 51 having contact points 51*a*, a linking section 52 for linking the terminal sections 51, and a terminal leg 53 extending downwardly from the linking section 52. An engaging hole 53*a* is provided in the terminal leg 53.

Figure 2:
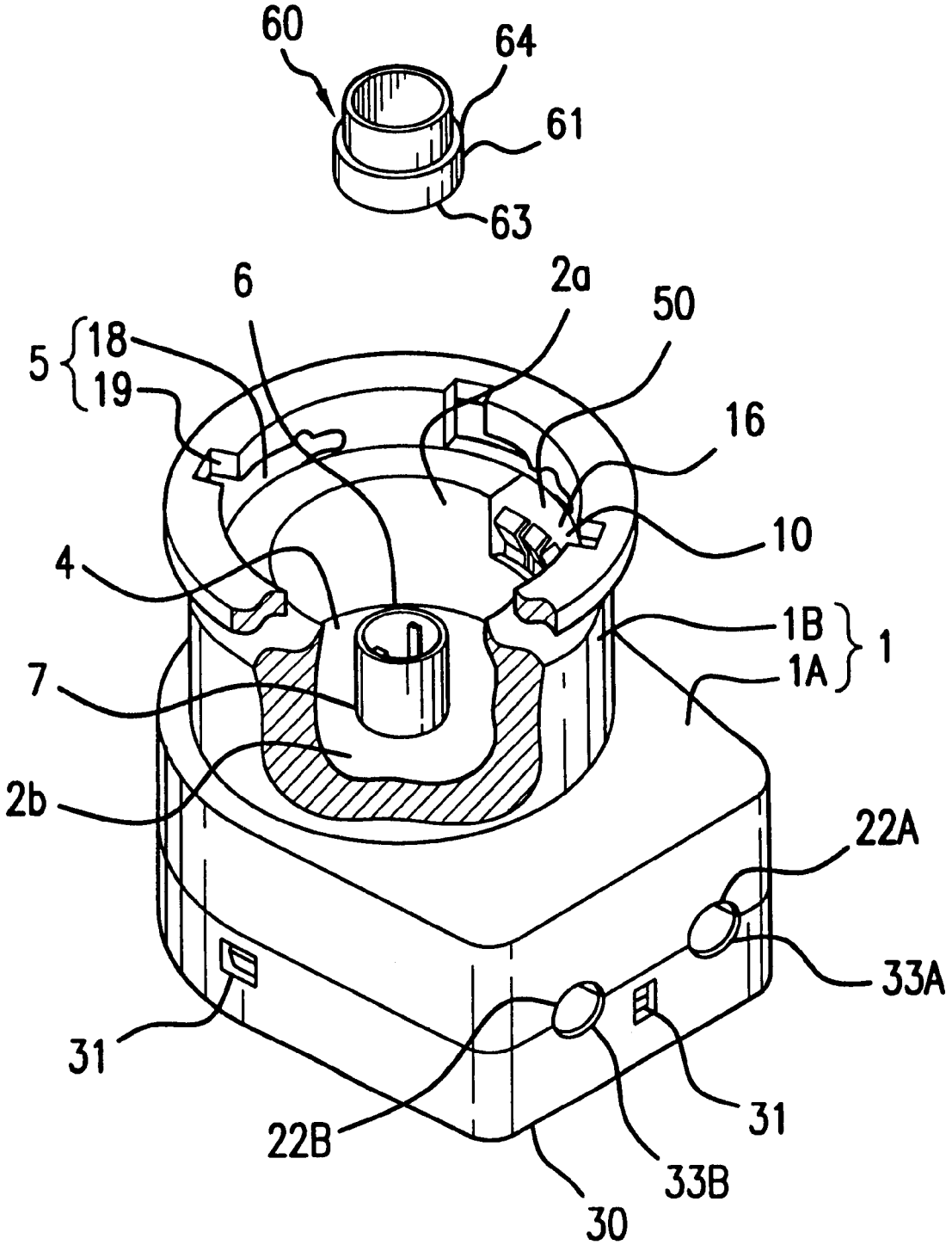
FIG. 2 is a partially cutaway, exploded perspective view of the lamp socket.

The insulation seal member 60 is made from an elastic material, such as urethan rubber, so as to provide a cylindrical seal body 61 as shown in FIG. 2. A seat portion 63 is provided on the bottom of the seal body 61. A stepped-down head portion 64 is provided on the top of the seal body 61.

In FIGS. 9A–9E, the seal insulation member 70 has an insulation body 71 which has the same shape as the loop-like seal press portion 14 provided in the back of the base section 1A. An engaging section section 73 is raised from a surface 72 on the side of the seal groove. A groove 75 is provided in a surface 74 of the insulation body 71 on the side of the socket body.

The first terminal 40 is mounted on the socket body 1 by inserting the press fitting section 41 into the mounting recess 9A of the first terminal mounting section 9. The lamp contact section 42 of the terminal 40 is located in the cylindrical section 6 while the terminal leg 43 projects into the mating terminal receiving cavity 3A via the terminal leg aperture 15.

The second terminal 50 is press fitted in the terminal mounting section 10 of the socket body 1. The contact point 51*a* of the terminal 50 projects into the socket fitting section 4 via the mating terminal receiving cavity 16A. The terminal leg 53 of the second terminal 50 projects into the mating terminal receiving cavity 3B via the terminal leg aperture 17.

The seal insulation member 70 is inserted in the seal groove 14 on the back of the cover 30. The engaging section 73 of the seal insulation member 70 engages the engaging recess of the seal groove 34. The circumferential wall 31 is fitted in the fitting wall section 11 of the base section 1A. The engaging holes 32 are engaged with the engaging projection 26 to mount the cover 30 on the base section 1A. The respective wire outlets 22A, 22B, 33A, and 33B of the socket body 1 and the cover 30 are aligned so that wires go out from these outlets.

The seal groove 34 of the cover 30 receives into the seal press portion 14 so that the end of the seal press portion 34 abuts on the groove 75 of the insulation member 70 for applying a pressure on the insulation member 70. Consequently, there is no space between the mating terminal receiving cavities 3A and 3B, making perfect insulation or separation.

Figure 10A:
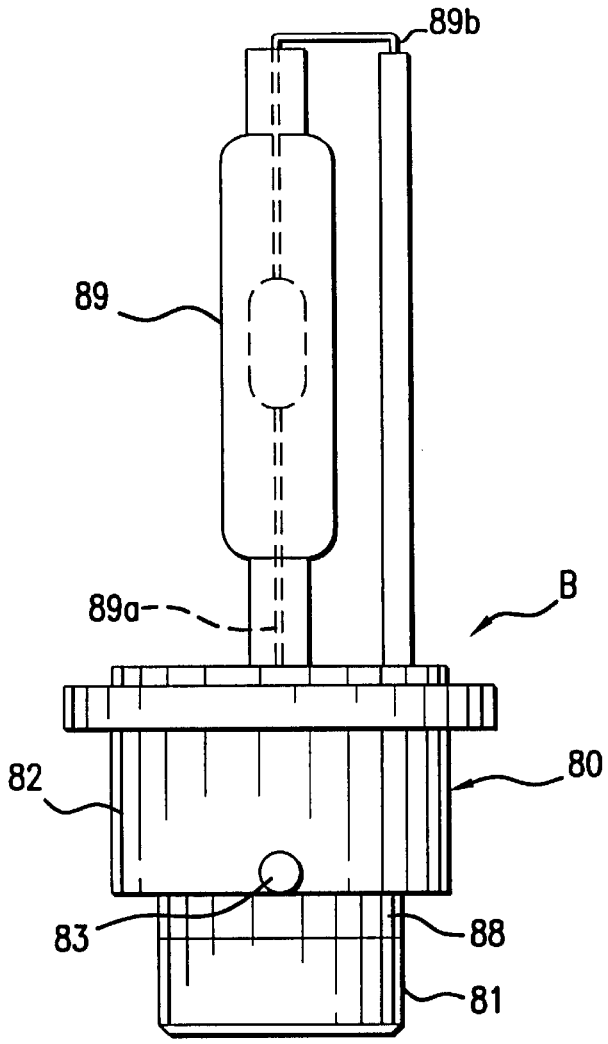
FIGS. 10A and 10B are a side view of a lamp and a bottom view of the lamp.
Figure 10B:
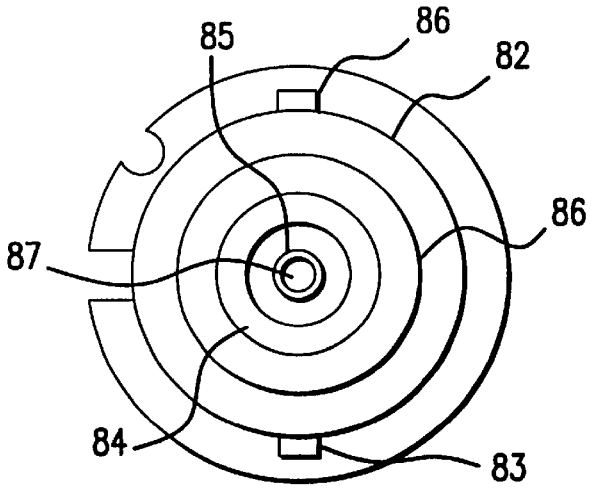
Figure 11A:
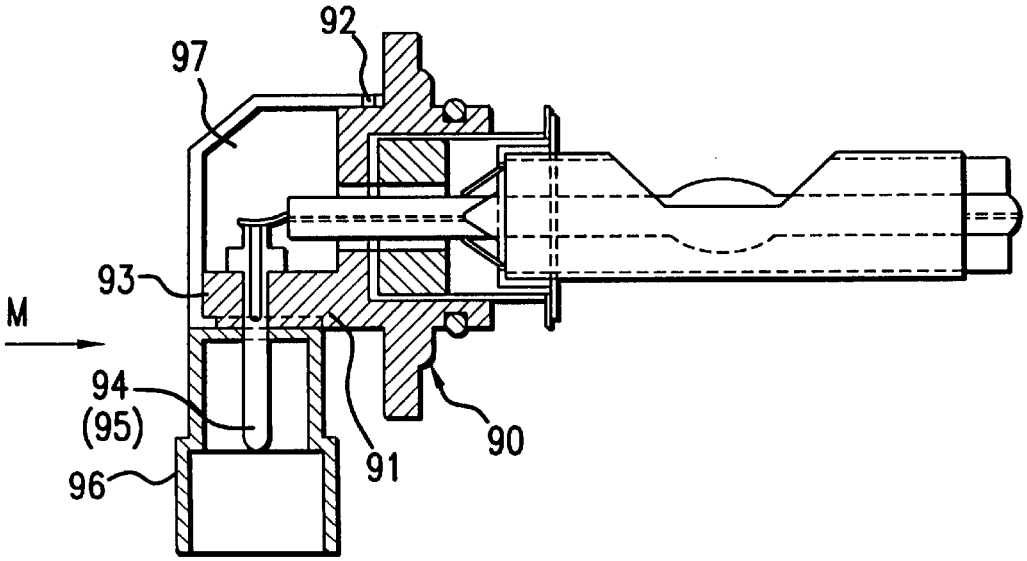
FIG.11A PRIOR ART
FIGS. 11A and 11B are a partially sectional side view of a conventional lamp socket, and a rear view of the socket viewed from an arrow M.
Figure 11B:
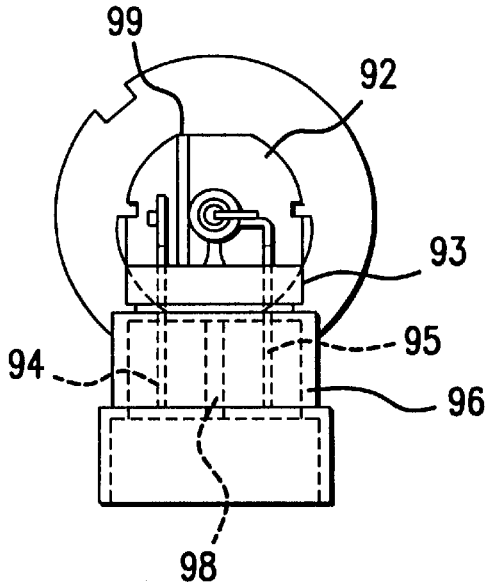
FIG.11B PRIOR ART

In FIGS. 10A and 10B, the lamp B has a lamp body 80, which includes a lamp fitting section 81 fitting to the socket fitting section 4 and an engaging section 82 for engagement with the lamp engaging section 5 of the lamp socket A. A plurality of engaging pins 83 are provided in the engaging section 82. A circular recess 84 is provided in the end face of the fitting section 81.

The lamp terminal 85 is mounted at the center of the lamp body 80. The contact section 87 of the lamp terminal 85 projects into the circular recess 84. The cylindrical contact 88 is provided on the circumferential wall of the lamp fitting section 81.

A bulb 89 is connected to a lamp connection section (not shown) of the lamp terminal 85 so that contacts 89*a* and 89*b* of the bulb 89 are connected to the lamp terminal 85 and the contact portion 88, respectively.

The thus constructed lamp B is mounted on the lamp socket A by fitting the lamp fitting section 81 to the socket fitting section 4 of the lamp socket A, inserting the engaging pins 83 of the engaging section 82 into the insertion grooves 19, and rotating the lamp B to engage the engaging pins 83 with the engaging holes 18. Consequently, the contact portions 87 and 88 of the lamp terminal 85 and the fitting section 81 are brought into contact with the lamp contact portion 42*a* and the contact point 51*a* of the second terminal 50, respectively.

As has been described above, according to the invention, the back surface of the base 1A within the fitting wall 11 is divided by the partition wall 12 into the first and second areas El and E2. The seal press portion forming wall 13 is provided in the area El at a predetermined distance from the fitting wall 11 and the partition wall 12 to form the loop-like seal press portion 14. The partition wall 20 is provided in the area El in a widthwise direction perpendicular to the longitudinal direction to define the first mating terminal receiving cavity 3A together with the seal press portion forming wall 13. The partition wall 21 is provided in the area E2 in the widthwise direction to define the second mating terminal receiving cavity 3B together with the fitting wall 11 and the partition wall 12. The terminal apertures 15 and 17 open in the first and second mating terminal receiving cavities 3A and 3B, respectively, so that the terminal legs 43 and 53 of the first and second terminals 40 and 50 project in the mating terminal receiving cavities 3A and 3B via the terminal apertures 15 and 17.

The seal insulation member 70 is fitted in the seal press portion 14, and the cover 30 is attached to the base section 1A such that the seal groove 34 is fitted in the seal press portion 14 to press the seal insulation member 70.

There is the seal press portion 14 (the partition wall 12 and the seal press portion forming wall 13) between the terminal legs 43 and 53 of the terminals 40 and 50, respectively, to increase the surface distance between the terminal legs 43 and 53. The seal insulation member 70 is fitted in the seal press portion 14 and pressed by the seal press section 34 of the cover 30 so that there is no space communicating between the mating terminal receiving cavities 3A and 3B.

Consequently, when there is an instantaneous high voltage, there is no spark running between the terminal legs 43 and 53 to prevent the fuse of the terminal legs.

According to one aspect of the invention there is provided a lamp socket comprising which includes a socket body having a socket fitting section; a first terminal mounting section provided at a center of the socket fitting section; a first terminal provided in the first terminal mounting section and having a first terminal leg; a second terminal mounting section provided in a circumferential wall of the socket fitting section; a second terminal provided in the second terminal mounting section and having a second terminal leg; first and second mating terminal receiving cavities provided in a back of the socket body; a seal groove surrounding the first mating terminal receiving cavity to separate the first mating terminal receiving cavity from the second mating terminal receiving cavity such that the first and second terminal legs project in the first and second mating terminal receiving cavities, respectively; a seal insulation member fitted in the seal groove; and a cover attached to the back of the socket body so that a seal press portion of the cover is fitted into the seal groove to apply a pressure on the seal insulation member so that there is the seal groove defined by the two separation walls between the first and second terminal legs so that there is a large surface distance between the two terminal legs and the seal insulation member is fitted in the seal groove and pressed by the seal press section of the cover so that there is no space communicating the mating terminal receiving cavities, thus completely insulating these terminal legs from each other.

Consequently, if an instantaneous high voltage is applied to these terminal legs, there is no spark produced between these terminal legs, and the number of assembling steps is not increased so that an inexpensive lamp socket is obtained.

By merely attaching the seal insulation member it is possible to completely insulate the these terminal legs from each other so that the number of assembling steps is small, providing an inexpensive lamp socket.

Also, the seal insulation member prevents the socket and the cover from making noise owing to the vibration of a vehicle.

According to another aspect of the invention, the engaging recess is provided in a part of the bottom of the seal groove, and the engaging projection is provided on a surface of the seal insulation member on the seal groove insertion side so that when the seal insulation member is fitted in the seal groove, the engaging projection is fitted in the engaging recess. With such a structure, when the seal insulation member is fitted in the seal groove, the engaging projection engages the engaging recess so that the seal insulation member is not displaced upon pressed by the seal press portions of the cover, thus assuring the insulation between the terminal legs.

What is claimed is:

1. A lamp socket comprising:

a socket body (1) having a socket fitting section (4) for receiving a lamp fitting section (81) of a lamp;

a first terminal mounting section (9) provided at a center of said socket fitting section (4);

a first terminal (40) provided in said first terminal mounting section (9);

a second terminal mounting section (10) provided in a circumferential wall of said socket fitting section (4);

a second terminal (50) provided in said second terminal mounting section (10);

a cover (30) attachable to said back of said socket body (1);

first and second terminal receiving cavities (3A, 3B) provided in said socket body (1);

a seal groove (34) provided in said cover (30) so as to surround said first terminal cavity (3A) and extending between said first and second terminal receiving cavities (3A and 3B) when said cover is attached to said socket body;

a seal insulation member (70) provided in said seal groove (34); and a seal press portion (14) provided on said back of said socket body (1) such that when said cover (30) is attached to said socket body (1), said seal press portion (14) is fitted into said groove (34) to press down said seal insulation member (70) in said groove (34).

* * * * *